United States Patent [19]

Reinartz et al.

[11] Patent Number: 4,628,162

[45] Date of Patent: Dec. 9, 1986

[54] FLUID LEVEL INDICATOR FOR A RESERVOIR

[75] Inventors: Hans-Dieter Reinartz, Frankfurt am Main; Helmut Steffes, Eschborn, both of Fed. Rep. of Germany

[73] Assignee: Alfred Teves GmbH, Frankfurt am Main, Fed. Rep. of Germany

[21] Appl. No.: 711,037

[22] Filed: Mar. 12, 1985

[30] Foreign Application Priority Data

Mar. 23, 1984 [DE] Fed. Rep. of Germany ..... 3410858

[51] Int. Cl.[4] ..... H01H 35/18

[52] U.S. Cl. ..... 200/84 C; 340/624; 73/313; 335/206

[58] Field of Search ..... 200/61.2, 81.4, 84 R, 200/84 C, 81.9 M; 340/624; 73/308, 313, 319; 335/153, 205, 207, 206

[56] References Cited

U.S. PATENT DOCUMENTS 3,250,866 5/1966 Ryno ..... 200/19
3,363,073 1/1968 Boguet ..... 200/81.9 M
4,015,226 3/1977 Stomma ..... 335/207
4,057,700 11/1977 Nakashima ..... 200/84 C
4,271,763 6/1981 Berger ..... 335/207
4,384,184 5/1983 Alvarez ..... 200/84 C

FOREIGN PATENT DOCUMENTS 2265427 5/1972 Fed. Rep. of Germany .
1120140 7/1968 United Kingdom .

*Primary Examiner*—G. P. Tolin
*Attorney, Agent, or Firm*—James B. Raden; Donald J. Breh

[57] ABSTRACT

The present invention is related to an electric switch comprising a magnet and a reed contact which is actuatable by the magnetic force of the magnet. The reed contact is shielded relative to the magnetic field of the magnet by means of a bell of magnetic field absorbing material which is furnished with an opening in the switching range of the reed contact to permit switch actuation. Exact switching points at the reed contacts are achieved by this arrangement.

4 Claims, 1 Drawing Figure

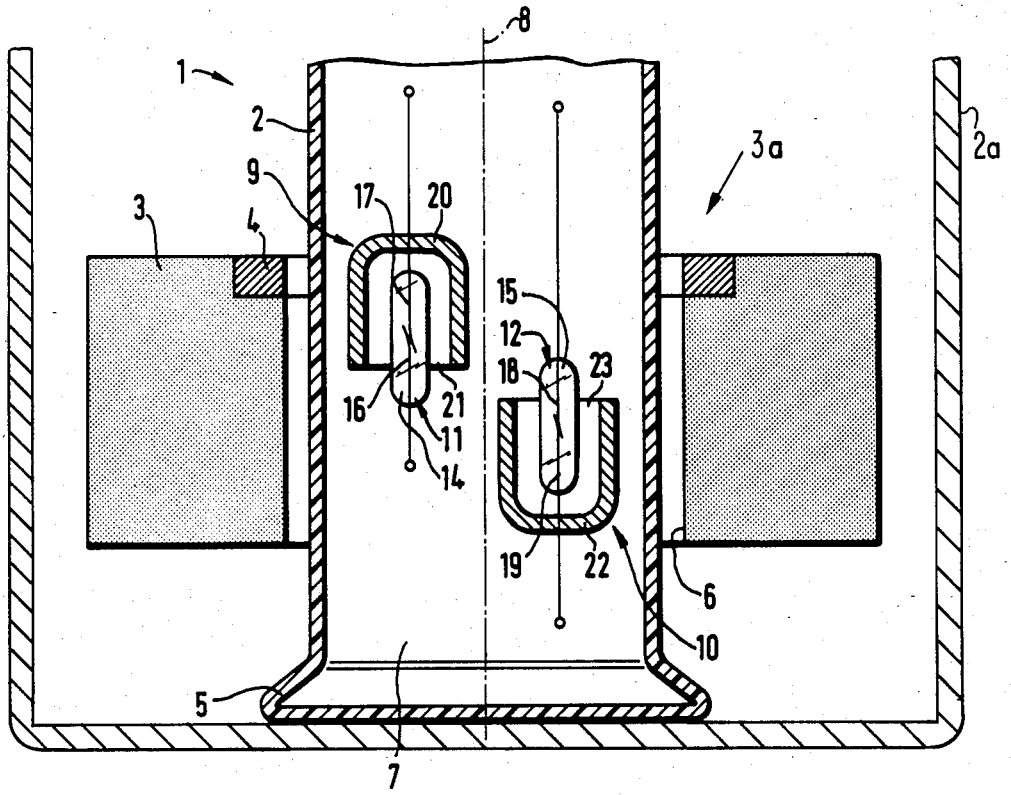
8
1
2
2a
3a
9
17
20
3
4
15
12
18
23
16
21
11
14
19
22
6
10
5
7

FLUID LEVEL INDICATOR FOR A RESERVOIR

BACKGROUND OF THE INVENTION

The present invention is related to an electric switch comprising a magnet and a reed contact which is actuatable by the magnetic force of the magnet.

One known type of electric switch is described in German patent specification No. 2,265,427. In this configuration, the reed contact is surrounded by the magnet which is fastened to the float. When the minimum liquid level is fallen short of, the electric switch is switched under the action of the magnetic force and gives a signal to a warning device which is connected to the electric switch. In such switch arrangements, the electric switch is frequently actuated incorrectly before the minimum liquid level is reached. The reasons for such erroneous triggering is that the amplitude of dispersion of the magnetic field is comparatively large and that the tolerances occurring during manufacture of the reed contact and of the magnet have a negative effect on the switching accuracy of the switch.

An object of the present invention is to provide an electric switch which switches exclusively when the magnet has assumed a determined position, independently of manufacturing tolerances and of the magnetic field.

SUMMARY OF THE INVENTION

According to the present invention, this object is achieved in that the reed contact is shielded relative to the magnetic field of the magnet by means of a cover. The cover is furnished with an opening in the range of the field of actuation of the reed contact. It accordingly becomes possible to arrange the opening at the reed contact in such a manner that a switching operation of the reed contact takes place reliably and always at the same point as soon as the magnet travels past the opening, that is, as soon the magnetic field enters into the opening. The field of dispersion of the lines of force of the magnet can no longer affect the reed contact without control, in a way that the reed contact switches in different positions of the magnet. According to the present invention, the lines of force radiating into the opening can actuate the reed contact only when the magnet has reached the level of the opening. This means that the exact switching point now depends on the exact position of the magnet and of the opening relative to the reed contact. Since the cover is fastened to the reed contact before the latter is installed, the exact switching point is defined depending on the position of the magnet before the electric switch is mounted.

A particularly efficient cover is attained when the cover is constituted by a plate which is made of mu-metal. Since the mu-metal has the property of largely absorbing the lines of force of a magnet without however radiating them to other metal bodies, only those lines of force penetrating through the opening may cause the switching action of the reed contact. Accordingly, the magnet must be positioned at the level of the opening for the switching to occur.

The present electric switch can be in a fluid level warning device for a fluid reservoir of a hydraulic system. Because the fluid used in hydraulic systems, especially in brake systems, is relatively expensive, heed has to be taken to avoid the unnecessary addition to fluid to the reservoir. One error leading to the unnecessary addition of fluid is the fact that the reservoir must have a greater volume that the volume of the fluid added to allow for switching tolerance. That deficiency is eliminated by the present fluid level warning device, since at the point at which the warning signal is triggered according to the present invention, the minimum admissible fluid level of the fluid reservoir is precisely reached.

In a particular embodiment of the present invention, the reed contact is fastened to the housing of the fluid reservoir and the magnet is fastened to a float which indicates the filling level of the fluid. The reed contact is shielded by the cover to such an extent that the reed contact switches exclusively when the magnet has assumed a predetermined position.

In a particular embodiment of the fluid reservoir in which the direction of motion of the magnet is in the longitudinal direction of the reed contact and in which the magnet and the float surround the reed contact in a ring-shaped configuration, the cover is formed by a bell which is fastened at the electric lead of the reed contact. The lead is arranged at the housing of the fluid reservoir, and has an exactly defined mounting position relative to the reed contact. Retrofitting of the bell to the current streamer of the reed contact can be carried out with particular ease. For that purpose, the reed contact is introduced into the bell for such a length that the end of the reed contact protruding from the opening of the bell is sufficient for the magnet to make contact.

When two electric switches are used in one fluid reservoir, then, advantageously, a second reed contact with a second bell is configured within the magnetic field of the magnet. The second reed contact is arranged substantially parallel to and slightly below the first reed contact, with the second bell extending in opposite direction to the first bell and with those portions of the reed contacts which project from the first bell and from the second bell facing each other and having a slight distance between each other in the direction of motion of the float. Owing to such arrangement, the second reed contact does not switch until the first reed contact indicates a minimum fluid level by its switching signal, such an arrangement will be required if the fluid reservoir supplies both a brake system and a pump provided to boost the braking power. In that case, the warning lamp of the brake system should first light up on reaching the minimum brake fluid level. The warning lamp of the central hydraulic system will light up some time later when the brake fluid level will have dropped still further. The pump is switched off simultaneously at this point to make sure that the residual amount of brake fluid is from then on utilized exclusively for the supply of the brake circuits of a vehicle and no longer for the supply of the pump.

In order that the electric switch is protected against dirt so as to retain its functioning ability and reliability in operation for many years without maintenance, the reed contact and the cover are usually arranged within a tubular body which is fastened in the fluid reservoir. The tubular body is sealed off from the fluid and surrounded by the float and magnet in a ring-shaped configuration.

BRIEF DESCRIPTION OF THE DRAWINGS

In the drawing, one embodiment of the present invention is illustrated in a longitudinal partial section.

DESCRIPTION OF THE PREFERRED EMBODIMENT

Referring now to the drawing the fluid level warning device 1 is comprised of a closed tubular body 2 which is fastened to the housing 2a of a fluid reservoir 3a for brake systems not shown in the drawing. Tubular body 2 may, for example, be suspended at the screw cap of the fluid reservoir, which cap is, on its part, screwed onto the filling opening of the reservoir to support tubular body 2 and which closes the fluid reservoir toward the atmosphere.

Tubular body 2 is surrounded by a ring-shaped float 3 bearing at its upper side magnet 4 which also is ring-shaped. In the embodiment illustrated, float 3 is shown as a solid body, so that its specific gravity must be lower than that of the fluid. Alternatively, float 3 may be configured in the shape of a hollow body.

Tubular body 2 is furnished with a ring-shaped extension 5 at its lower end as viewed in the drawing. As the external diameter of extension 5 is larger than the internal diameter of cylindrical wall 6 of float 3, it is safeguarded that float 3 cannot leave tubular body 2 in a downward direction as viewed in the drawing when the fluid reservoir is empty or during its mounting in the fluid reservoir. Tubular body 2 is made of plastic in order to insure that the magnetic field generated by magnet 4 can penetrate through tubular body 2.

In interior space 7 of tubular body 2, two electric switches 9 and 10 are configured one each on either side of the center line 8 of tubular body 2. Electric switches 9 and 10 are each comprised, respectively, of a reed contact 11, 12 which extends in the longitudinal direction of the center line 8. Reed contacts 11, 12 consist respectively, of a glass tube sheating 14, 15 within which the two contact lugs 16, 17 and 18, 19, respectively, extend in the longitudinal direction of the reed contacts 11, 12. Contact lugs 17 and 18 leave the glass tube sheathing 14 and 15, respectively in an upward direction as viewed in the drawing. Contact lugs 16, 19 leave the glass tube sheathing 14 and 15, respectively in a downward direction as viewed in the drawing. The ends of the contact lugs 15, 17 and 18, 19 in the glass tube sheathing 14 and 15, respectively, represent the switching points of the electric switches 9 and 10. When the ends of the contact lugs 16, 17 of the reed contact 11 which are facing each other are disconnected, reed contact 11 is switched off. When the ends of the contact lugs 18, 19 of reed contact 12 which are facing each other are interconnected, the electric switch 10 is short-circuited or switched on.

The upper ends of the contact lugs 17, 18 as viewed in the drawing are connected to the power source of a vehicle battery. The lower contact lugs 16, 19 as viewed in the drawing are connected to an electrical load. In the embodiment illustrated, contact lug 16 is connected to a warning lamp located in the passengers' space, whereas contact lug 19 is linked to the hydraulic fluid pump supplying the brake system of an automotive vehicle with hydraulic fluid.

Reed contact 11 is shielded from above by means of a cover 20 in the shape of a bell in a way that only the lower end of reed contact 11 projects from the downwardly directed opening 21 of bell 20. Bell 20 is fastened to upper contact lug 17.

Reed contact 12 is covered from below by means of bell 22 in such a way that the upper end of reed contact 12 protrudes from upwardly directed opening 23 of bell 22. Bell 22 is fastened to contact lug 19. Owing to the fact that bells 20, 22 are fastened to the respective contact lugs 17 and 19, reed contacts 11, 12 are adjusted with regard to the switching points.

The mode of functioning of the present fluid level warning device is as follows:

When the brake fluid level drops downwardly as viewed in the drawing, float 3 and magnet 4 will go down the same extent. When magnet 4 arrives at the level of bell 20, the lines of force generated by magnet 4 will be absorbed by bell 20 without affecting reed conact 11, since bell 20 is made of a metal which, although it absorbs magnetic forces, does not retransmit them to internal spaces. A material featuring such properties is, for example, mu-metal. There are other materials offering these properties.

As float 3 and magnet 4 continue to sink down, magnet 4 will then reach the level of opening 21 of bell 20. From this point on, the lines of force of magnet 4 can now reach reed contact 11, as a result whereof reed contact 11 is triggered. That is to say that, having been open before, it will now be closed, by switching under the effect of the magnetic force. In consequence of the switching action, a warning lamp (not shown) will be energized to warn the driver that the brake fluid in the fluid reservoir has reached a minimum.

If in spite of this warning no maintenance work is carried out on the brake system but instead the brake system is continued to be used, then in the event of a further descent of float 3, reed contact 12 will be triggered by the magnetic force of the magnet 4. That means reed contact 12 will be switched off since reed contact 12 was switched on in the initial state. The hydraulic fluid pump is so switched off, with the result that the hydraulic boosting at the brakes and/or at the steering of the vehicle is ceased. Simultaneously a further warning lamp (not shown) pertaining to the hydraulic supply system will be energized.

It is therefore possible by bells 20 and 22 to exactly predetermine the two switching points of electric switches 9, 10 depending on the position of magnet 4 by exactly adjusting reed contacts 11, 12 when they are being installed in tubular body 2.

What is claimed is:

1. A fluid level indicator for a master cylinder reservoir comprising:

a float mounted on said reservoir for movement in response to changes in the level of fluid in said reservoir;

a magnet mounted to said float at a predetermined location therein for creating a magnetic field;

a contact switch assembly including a magnetically operable reed contact adapted to be electrically coupled to an electrical circuit and a magnetic field shield around said reed contact, said shield including an opening, said reed contact and said shield affixed together with said opening disposed at a constant first predetermined position relative to said reed contact providing for passage of said magnetic field therethrough to operate said reed contact, and said contact switch assembly is fixedly mounted within said reservoir with said opening in said shield disposed at a second predetermined position relative to said reservoir, said first predetermined position of said opening and said second predetermined position of said opening defining a desired fluid level in said reservoir.

2. The fluid level indicator of claim 1, wherein said shield is bell shaped and comprised of mu-metal having an opened end defining said opening, said reed contact includes a pair of leads, one lead being affixed to a closed end of said bell shaped shield.

3. The fluid level indicator of claim 1 wherein said contact switch assembly is arranged within a tubular body which is fastened in the fluid reservoir, said tubular body being sealed off from fluid in said reservoir and is surrounded by said float and said magnet in a ring-shaped configuration.

4. The fluid level indicator of claim 2 further comprising a second switch contact assembly including a second bell shaped magnetic field shield mounted to and surrounding a second reed contact with an open end thereof disposed at a first predetermined fixed location relative to said second reed contact, said second switch contact assembly mounted within said reservoir with said open end thereof at a second predetermined fixed location relative to said reservoir, said opening of said second shield opening toward and spaced from said opening of said first shield, said second reed contact adapted to be connected to a second electrical circuit.

* * * * *